United States Patent [19]

Hockenbrock et al.

[11] 4,326,762

[45] Apr. 27, 1982

[54] APPARATUS AND METHOD FOR SPOT-KNOCKING TELEVISION PICTURE TUBE ELECTRON GUNS

[75] Inventors: Richard L. Hockenbrock, Mundelein; James W. Schwartz, Deerfield, both of Ill.

[73] Assignee: Zenith Radio Corporation, Glenview, Ill.

[21] Appl. No.: 197,031

[22] Filed: Oct. 15, 1980

Related U.S. Application Data

[63] Continuation of Ser. No. 34,787, Apr. 30, 1979, abandoned.

[51] Int. Cl.[3] ..... H01J 9/00

[52] U.S. Cl. ..... 316/1; 316/27

[58] Field of Search ..... 316/1, 26, 27, 32; 324/404; 313/325

[56] References Cited

U.S. PATENT DOCUMENTS

| | | | |
|---|---|---|---|
| 2,171,224 | 8/1939 | Rose | 316/1 |
| 2,285,551 | 6/1942 | Zworykin | 316/1 |
| 3,267,321 | 8/1966 | Gessford, Sr. | 313/325 |
| 3,736,038 | 5/1973 | Nakanishi et al. | 316/26 |
| 3,995,194 | 11/1976 | Blacker, Jr. et al. | 315/16 |
| 4,038,616 | 7/1977 | Ball | 324/404 |
| 4,101,803 | 7/1978 | Retsky et al. | 315/3 |
| 4,124,263 | 11/1978 | Neuber et al. | 316/1 |

FOREIGN PATENT DOCUMENTS 1532228 11/1978 United Kingdom .

OTHER PUBLICATIONS

"Flashover in Picture Tubes and Methods of Protection", A. Ciuciura, The Radio and Electronic Engineer, Mar. 1969.

*Primary Examiner*—John McQuade

*Attorney, Agent, or Firm*—Ralph E. Clarke, Jr.

[57] ABSTRACT

Apparatus and method is disclosed for spot-knocking a cathode ray picture tube by beneficial arcing between selected electrodes of an electron gun sealed in the evacuated envelope of the tube. The invention is particularly useful in spot-knocking certain cathode ray picture tubes having a resistive arc-suppression means and static elimination system. The picture tube has an inherent capacitance that can store energy in an amount capable of inducing destructive arcing during spot-knocking. In one embodiment of the invention, a bipolar potential is applied across the electrodes to be spot-knocked, resulting in the amount of energy in the induced arcing, for a given applied potential, being very much less than would be the case if a unipolar potential were applied. Other embodiments include resistive means and spark gap means for discharging the voltage between lead-in pins before a destructive arc can occur therebetween.

13 Claims, 10 Drawing Figures

APPARATUS AND METHOD FOR SPOT-KNOCKING TELEVISION PICTURE TUBE ELECTRON GUNS

CROSS-REFERENCE TO RELATED APPLICATION

This application is a continuation of application Ser. No. 034,787 filed Apr. 30, 1979, now abandoned.

BACKGROUND OF THE INVENTION AND DISCLOSURE STATEMENT

This invention concerns an improved apparatus and method for high-voltage conditioning, or "spot-knocking," electron tubes including television cathode ray picture tubes having certain resistive arc-suppression means.

Electron guns for television cathode ray picture tubes usually comprise a series of discrete, electrically conductive discs or tubular element contiguous to each other and aligned on a common axis. In multi-gun assemblies, each gun may comprise a series of electrically discrete electrodes, or, the electrodes of the gun which have functions in common may be physically combined, or "unitized." The electrodes receive voltages of a predetermined potential to establish electrostatic fields therebetween for forming and shaping the electron beam, and, in the main focus lens section of such guns, for imaging a beam cross-over to provide small, symmetrical beam "spots" on the screen. The electrodes of the main focus lens of such guns are typically closely spaced and have widely varying potentials thereon; e.g., potentials ranging from 4 to 30 kilovolts or more.

Consequent to the process of manufacture of the metallic electrodes, in which shearing, stamping, and coining are typical process, surface imperfections such as burrs, spikes and other detritus may project from the surface of the electrode. Because of the close spacing of the electrodes and the wide disparity in potential on adjacent electrodes, such projections can become point sources for inter-electrode arcing. Arcing can cause visible flashes and popping noises discomforting to the viewer, and possible destruction of the cathode ray tube itself and/or its ancillary components and circuits.

It is a well-known manufacturing practice to induce beneficial arcing between electrodes to expunge such projections by a process commonly known as spot-knocking. Typically, the electrode nearest the screen, commonly known as the anode electrode, is charged with a high potential, while the adjacent electrode is held at ground potential. Arcing is deliberately induced between the two electrodes by techniques such as raising the anode potential to higher than normal voltage, typically in the range of 40 to 50 kilovolts; pulsing the voltage; and/or applying a radio frequency component. The arcing that results removes the projections and in consequence, no arcing ordinarily occurs when the gun is operated at its normal potential.

FIG. 1 is a simplified schematic diagram of a spot-knocking circuit 10 in common use. A cathode ray tube 11 is symbolically represented as having two electrodes 12 and 13 enclosed in the evacuated envelope and between which spot-knocking is to be induced. Electrode 12 represents the "lower end" electrodes nearest the base of the tube 11; that is, the heater and cathodes, the prefocusing electrodes, and one or more of the main focusing electrodes, all of which are typically electrically interconnected and connected to ground through a lead-in pin 14. Electrode 13 represents the electrode nearest the faceplate and is commonly termed the anode electrode, receiving as it does the anode voltage on the faceplate screen as supplied by a high voltage source 15 through an anode button 16, all as is well-known in the art. A positive voltage from a spot-knocking high-voltage source 18, typically in the range of 35 to 50 kilovolts, is conducted to anode button 16 through a current-limiting resistor 20. When high-voltage source 18 is activated, the difference in potential between electrodes 12 and 13 results in the desired beneficial interelectrode arcing, or spot-knocking. The type of power source shown can be described as "unipolar"; that is, a single potential of one polarity is provided, which in the example shown, is of positive polarity.

A problem that restricts the utility of the spot-knocking circuits shown by FIG. 1 is attributable to the inherent capacitance 22, indicated by the dashed lines, of the picture tube, its electrodes and associated conductors. This inherent capacitance puts a limit on a magnitude of the voltage that can be supplied for spot-knocking purposes. If the voltage is raised much higher than 50 kilovolts, for example, the energy stored in the inherent capacitance 22 increases to a high level. As a result, when spot-knocking arcing does occur, the release of stored energy is of such magnitude that, rather than being beneficial, the resultant arcing can be highly destructive both to the gun and the cathode ray tube itself.

A problem arises in attempting to spot-knock cathode ray tubes having certain resistive arc-suppression means. A tube having such means is disclosed in U.S. Pat. No. 4,101,803 to Retsky et al., assigned to the assignee of this invention. It is manifest that the electron gun of a cathode ray tube having means to suppress arcing (as the Retsky et al. U.S. Pat. No. 4,101,803 invention effectively demonstrates) would not ordinarily be compliant to the prior art spot-knocking process.

Nakanishi et al.—U.S. Pat. No. 3,736,038 discloses a method for spot-knocking electron tubes such as a cathode ray picture tube. The disclosure is addressed to rendering a standard spot-knocking process effective with respect to more than two of the electrodes of an electron gun. That is, spot-knocking is alleged to be accomplished not only between a first electrode at the anode potential and a second electrode adjacent thereto, but also between the second electrode and a third electrode adjacent thereto. This additional function is the result of the insertion of resistive means in the circuit that causes a rise of potential of the second electrode concurrent with the spot-knocking arc effective to induce a spot-knocking arc between the second and third electrodes. The potential for arcing between lead-in pins would seriously restrict the magnitude and hence efficacy of the spot-knocking potential that could be employed.

In U.S. Pat. No. 4,124,263, Neuber et al. discloses a process for the high-voltage conditioning of cathode ray tubes. The process is described as being applicable to the high-voltage conditioning of the type of cathode ray tube having an electron gun with more two main focus electrodes (termed a "tri-potential focus type") that require relatively high operating potentials supplied through the tube base pins. One aspect of the invention comprises a special tube socket adapted for receiving the tube base, and a container of high-dielectric-strength fluid into which the assembled socket and base is immersed to inhibit inter-pin arcing during high-voltage conditioning. Major disadvantages in the process include the high cost of the dielectric fluid, and the contaminative nature of the fluid which mandates that the high-voltage conditioning process be confined to an area apart from the main production line. Also, the requirement to utilize containers of the fluid renders the process cumbersome.

"Flashover in Picture Tubes and Methods of Protection" is the title of a paper by A. Ciuciura that appeared in the Journal of the Institution of Radio and Electronic Engineers in March 1969. Flashover protection is described as being provided in picture tubes by spark gaps assisted by series resistors.

U.S. Patent No. 1,532,228 (Great Britain) discloses spark gap and discharge path arrangement for a television picture tube or other cathode ray tube. Apparatus is provided comprising a cathode ray tube having an envelope of dielectric material with inner anJ outer conductive coatings, an ultor electrode coupled to the inner coating, a high voltage focus electrode in close proximity to the ultor electrode, and a plurality of low voltage electrodes in proximity to the focus electrode. The first spark gap has a first terminal coupled to the focus electrode and a second terminal directly coupled to the outer coating, which coating is at a reference potential. The spark gap has a breakdown potential lower than the breakdown potential between the focus electrode and an adjacent low voltage electrode. A plurality of second spark gaps have respective first terminals coupled to respective low-voltage electrodes, and respective second terminals directly coupled to the outer coating along a path separate from the direct coupling of the second terminal of the first spark gap to the outer coating. The general object of the invention is stated to be to prevent discharge currents and associated high voltage from one spark device from undesirably coupling back through the common return to affect the operation of other spark gaps.

OBJECTS OF THE INVENTION

It is a general object of this invention to provide improved apparatus and method for spot-knocking the electron guns of cathode ray picture tubes.

It is a general object to provide improved spot-knocking apparatus and method for cathode ray tubes having electron guns of types such as the unipotential, the bipotential, and guns having the extended field main focus lens.

It is a less general object of this invention to provide apparatus and method that will reduce production costs in terms of simplificaion of apparatus, reduction in processing time, and reduction in labor costs.

It is another less general object of the invention to provide apparatus and method for spot-knocking cathode ray tubes having certain resistive arc-suppression means.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify the elements, and in which:

DESCRIPTION OF THE PREFERRED EMBODIMENT

Figure 1:
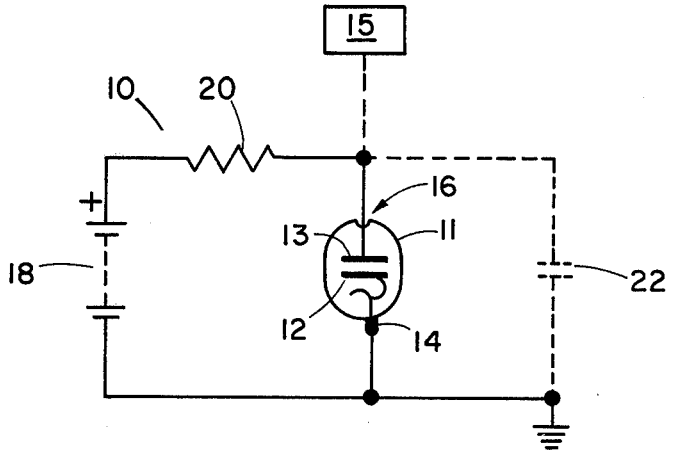
Fig. 1 PRIOR ART
FIG. 1 is a schematic diagram of a basic circuit used in prior art spot-knocking means.
Figure 2:
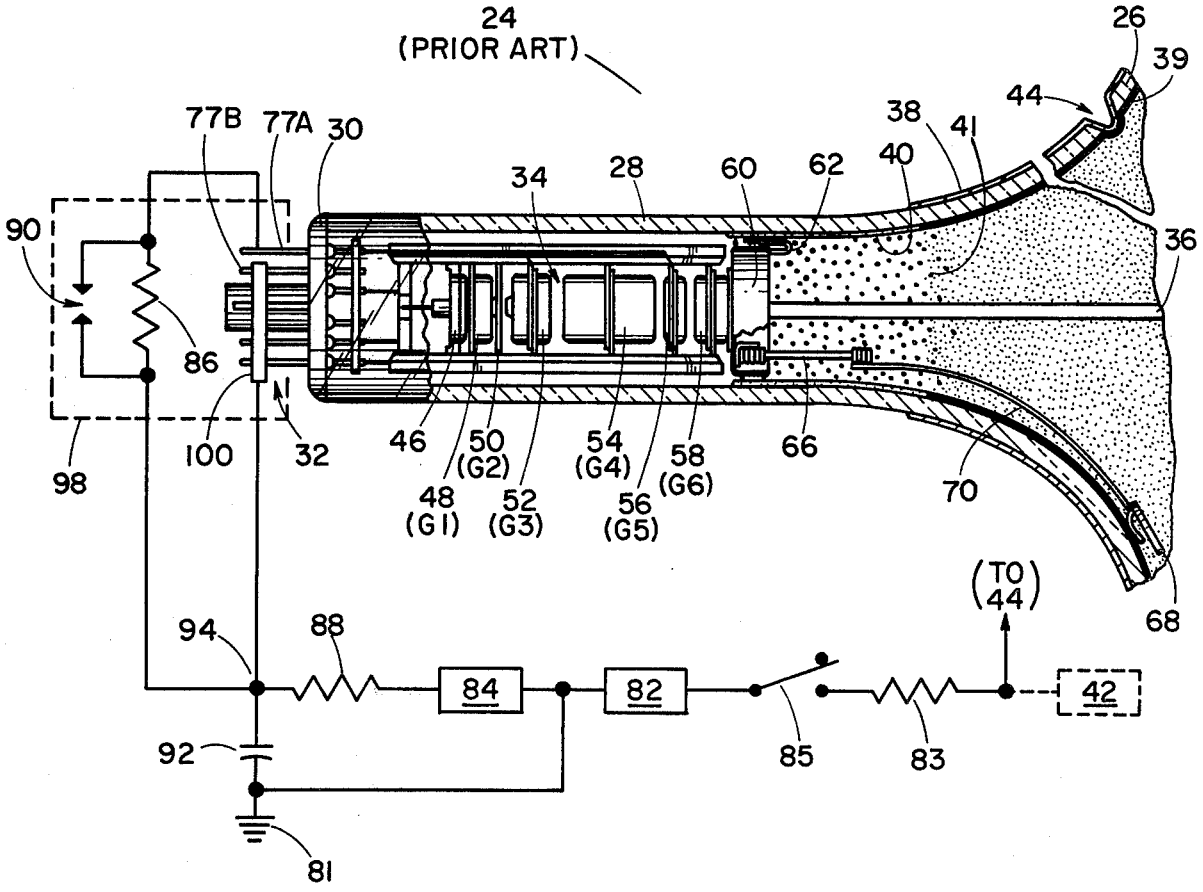
FIG. 2 is a view of FIG. 6 of U.S. Pat. No. 4,101,803, with certain reference numbers removed or changed, and with apparatus according to the present invention indicated in schematic diagram form.

The cathode ray picture tube shown by FIG. 2 and indicated by reference number 24, is distinguished by having an extended field main focus lens as disclosed and claimed in U.S. Pat. No. 3,995,194. It is further distinguished by having an arc-suppression and static elimination system as disclosed and claimed in U.S. Pat. No. 4,101,803. The foregoing patents are of common ownership with the assignee of the present invention. It is to be noted that the invention disclosed herein is not restricted to extended field lens guns, but is readily applicable to types including the bipotential and unipotential. Further, the invention has application to cathode ray picture tubes having no arc-suppression or static elimination components, as will be shown.

FIG. 2, provided for exemplary purposes, shows a readily recognizable portion of the evacuated envelope of a prior art cathode ray picture tube 24, including a part of a glass funnel 26 joined to a neck 28. Picture tube 24 is shown as having a resistive arc-suppression means and static elimination system according to the U.S. Pat. No. 4,101,803 disclosure. The neck 28 is terminated by a base 30 which supports a plurality of electrical lead-in pins 32 extending through the evacuated envelope, and through which electrical conduction is made between circuits of the television receiver chassis (not shown) and components within the interior of the tube 24. The evacuated envelope of tube 24 includes a faceplate with a luminescing screen (not shown). The picture tube has an inherent capacity that can store energy in an amount capable of supporting a destructive arc during spot-knocking.

In the neck 28 of tube 24 is disposed an electron gun 34 which generates three coplanar electron beams, shown edge-on at 36. The tube has an outer conductive coating 38 deposited on funnel 26; coating 38 is commonly held at ground potential. An inner conductive coating 39 receives a high voltage from an external high voltage source 42 through a feed-through conductor 44, or "anode button," which is in contact with inner conductive coating 39. The outer and inner conductive coatings 38 and 39 constitute a high-voltage filter capacitor.

The embodiment according to U.S. Pat. No. 4,101,803 shown by FIG. 2 is distinguished by the fact that there is in addition to the normal inner conductive coating 39, an anti-static coating 40 is contact with inner conductive coating 39 in overlap area 41. The anti-static coating comprises an important component of the resistive arc-suppression system described and claimed in U.S. Pat. No. 4,101,803.

Electron gun 34, which is shown as having an extended field main focus lens, is comprised of lower-end electrodes proximate to base 30, including heaters and cathodes 46, first and second prefocus electrodes 48 and 50; and upper-end main focus third, fourth, fifth and sixth electrodes 52, 54, 56 and 58, respectively proximate to the faceplate. Sixth electrode 58, also termed the "anode electrode," is physically and electrically attached to shield cup 60. Extending from shield cup 60 are a plurality of snubber springs 62 which make electrical contact with anti-static coating 40. (In conventional cathode ray picture tubes, coating 40 would comprise the inner conductive coating). Thus, sixth electrode 58 is electrically connected to the inner conductive coating. It is to be noted that third and fifth main focus electrodes 52 and 56 are electrically interconnected internal to the envelope of tube 24 and connected in turn to a first lead-in pin 77A.

The arc-suppression means according to the aforementioned U.S. Pat. No. 4,101,803 is a discrete element which serves as the main-arc-current-dissipation constituent of the resistive system. The arc-suppression resistor 66 is physically and electrically attached to shield cup 60, as indicated. The arc-suppression resistor 66 in turn supports a getter 68 by means of an electrically conductive leaf spring 70. Getter 68 makes electrical contact with inner conductive coating 39, as indicated.

Should conditions exist for an arc to occur between the electrodes of electron gun 34 as a result, for example, of a foreign particle lodging in the narrow inter-electrode space of gun 34, or projecting from the face of an electrode, an arc current will propagate through the arc-suppression resistor 66, through the electrodes of gun 34, and associated gun circuits (not shown) to an electrical ground within the television receiver system. As a result of the invention described in the referent U.S. Pat. No. 4,101,803, tubes having an arc-suppression and static elimination system according to the cited invention were shown to hold up without arcing at forty kilovolts, forty-five kilovolts, and fifty kilovolts or even higher before significant arcing occurred. When the tube did arc, the arcing currents were typically no more than a harmless ampere or less.

The nullifying effect of such arc-suppression efficacy on the standard prior art spot-knocking process will be readily recognized. Even though destructive arcing is suppressed by the means according to the U.S. Pat. No. 4,101,803 invention, yet inter-electrode clean-up by spot-knocking is considered necessary, and is accomplished according to the present invention, as will be shown.

Figure 3:
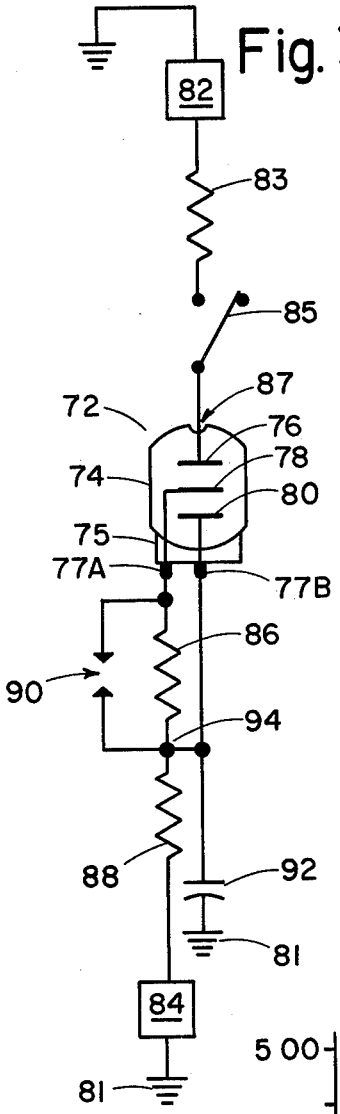
FIG. 3 is a schematic diagram of a preferred embodiment of the spot-knocking apparatus according to the invention.

A preferred embodiment of the novel spot-knocking apparatus according to the invention is first described in simplified form with reference now to FIG. 3, which is a schematic diagram of the apparatus with essential electrical components that provide for spot-knocking according to the invention. A cathode ray tube 72 is symbolically indicated as having a base 75 and first and second lead-in pins 77A and 77B for conducting electrical potentials through the evacuated envelope 74. The electrodes of an electron gun within the envelope 74 which are spot-knocked according to the invention include, for example, a first electrode which is the anode electrode 76; that is, the electrode of the gun proximate the faceplate and which receives the high voltage from the inner conductive coating as described heretofore. In bipotential electron guns, this anode electrode is commonly designated as the fourth electrode, G4; in most extended field guns, this anode electrode is designated the sixth electrode, G6.

The second electrode, electrode 78, represents the electrode adjacent the anode electrode; in most bipotential guns which have two-element main focus lenses, electrode 78 is commonly designated as the third electrode, G3. In application of the FIG. 3 circuit to the extended field lens gun, the second electrode 78 represents the tied-together electrodes commonly designated as G3 and G5.

A third electrode, electrode 80, represents all other electrodes in the lower end of the gun proximate the base 75, that is, the heater and cathodes, and the prefocusing electrodes, all of which are commonly electrically interconnected for the purpose of spot-knocking.

A first high-voltage source 82 is shown as being electrically connected to anode electrode 76 through a current-limiting resistor 83 which may have a value, for example, of two megohms. The connection of the first high voltage source 82 to the anode electrode 74 is through the associated feed-through conductor 87 extending through envelope 74. First high-voltage source 82 provides a first potential having a value at least long term average which is many kilovolts positive relative to a predetermined ground 81; for example, thirty to fifty kilovolts which may be supplied by a power source providing half-wave direct current. The potential is preferably adjustable in the cited range. Also, the output of first high-voltage source 82 can be cycled on and off by means of a switch 85, indicated schematically.

A second high-voltage source 84 is shown as being electrically connected to second electode 78 through an associated electrical conductor extending through envelope 74, and shown as being first lead-in pin 77A. Second high-voltage source 84 supplies a second potential having a value at least long-term average which is many kilovolts negative relative to ground 81. The difference between the first potential and second potential is such as to induce the desired beneficial arcing between the electrodes known as spot-knocking. High-voltage source 84 may comprise a full-wave filtered power supply which may provide, for example, a negative potential of a selected value in the range of minus fifteen to minus thirty kilovolts. The output of second high-voltage source 84 is routed to electrode 78 through series-connected first resistor 86 located nearest lead-in pin 77A and second resistor 88; resistor 86 may have a value of, for example, one megohm, and resistor 88 a value of fifteen megohms. Resistor 86 is shown as being in parallel connection with spark gap 90 in accordance with an embodiment of the invention; spark gap 90 may have a breakdown potential of about twenty kilovolts, for example. Third electrode 80 is connected to group as shown through a second lead-in pin 77B and a capacitor 92, which may have a value, by way of example, of 250 picofarads. Electrode 80 is also connected to a terminal of spark gap 90 at connection point 94, as shown.

Spot-knocking between electrodes 76, 78 and 80 can be initiated by the closing of switch 85 and upon activation of first and second power sources 82 and 84. First high voltage source 82 is adjusted to provide a potential of fifty kilovolts, for example, to electrode 76, while second high-voltage source 84 may be adjusted to provide a potential of minus twenty kilovolts to electrode 78 through series-connected resistors 86 and 88. The seventy kilovolts difference in potential between electrodes 76 and electrode 78 induces beneficial arcing therebetween. Resistor 88 acts as a current limiter, allowing capacitor 92 to control the current of second high voltage source 84. When the desired arcing occurs between electrodes 76 and 78, the potential on electrode 78 rises to the level of positive voltage sufficient to induce arcing between electrodes 78 and electrode 80, which is yet at a potential of minus twenty kilovolts. Arcing is maintained by the flow of current through resistor 88, which slows the equalization between electrodes 76 and 78. The respective functions of spark gap 90 and capacitor 92 according to the invention are described in following paragraphs in relation to associated circuits.

First and second high voltage sources 82 and 84 as described function as a "bipolar" power supply, producing both a positive potential and a negative potential relative to a predetermined ground or reference potential. The primary benefit in a bipolar source for spot-knocking according to the invention is that by the application of a bipolar potential across the electrodes, the amount of energy in the induced arcing, for a given applied potential, is very much less than would be the case if a unipolar potential were applied. By keeping the amount of energy which is stored in the inherent capacitance at a low level, the energy of the spot-knocking arcing is so low as to be non-destructive, yet the energy level is high enough for effective electrode clean-up. An arcing energy level of ten to one hundred millijoules is considered to be efficaceous, while an energy level appreciably greater, especially in the greater than three hundred millijoule range, can be highly destructive.

Figure 4A:
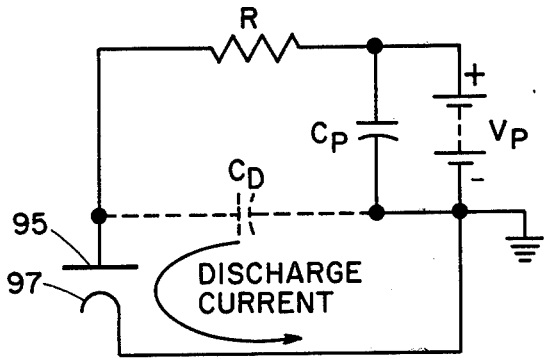
FIGS. 4A and 4B indicate diagrammatically the storage and discharge of energy in a unipolar power source, and a bipolar power source respectively, according to the invention.

Each capacitance has stored energy E in the amount given by the well-known formula $$E=\tfrac{1}{2}CV^2 \tag{1}$$

where c is the particular capacitance and V is the potential across that capacitance. There are many lumped and distributed capacitances associated with an actual spot-knocking apparatus/tube system. In a conventional spot-knocking system, however, we may consider these reduced to only two equivalent capacitors. One is the storage capacitance associated with the high-voltage power supply $V_P$ as shown in the unipolar power supply of FIG. 4A wherein a spot-knocking arc is induced between electrode 95, which can be considered the anode electrode, and an adjacent electrode, electrode 97. Resistor R inserted between the anode electrode 95 and the power source $V_P$ is typically used to largely decouple or isolate the storage capacitance from the discharge circuit. However, stray inherent capacitance in electrical conductors, the capacitance between the tube and its surroundings, shunt capacitance of the isolating resistor R, etc., make it impossible to completely eliminate all capacitive effects. An equivalent residual capacitance $C_D$ indicated by the dash lines, is considered to be connected directly between anode 95 and the reference potential, indicated by the ground symbol. The value of residual capacitance $C_D$ may typically be several hundred picofarads. If power supply $V_P$ charges the residual capacitance $C_D$ to 70 kilovolts, and $C_D$ is assumed to be 200 picofarads, the stored energy E in millijoules is $$E=\tfrac{1}{2}\times 200\times 10^{-12}\times(70\times 10^3)^2=490\text{ mJ} \tag{2}$$

this great a value; that is, 490 millijoules, may be destructive to gun parts during spot-knocking.

Figure 4B:
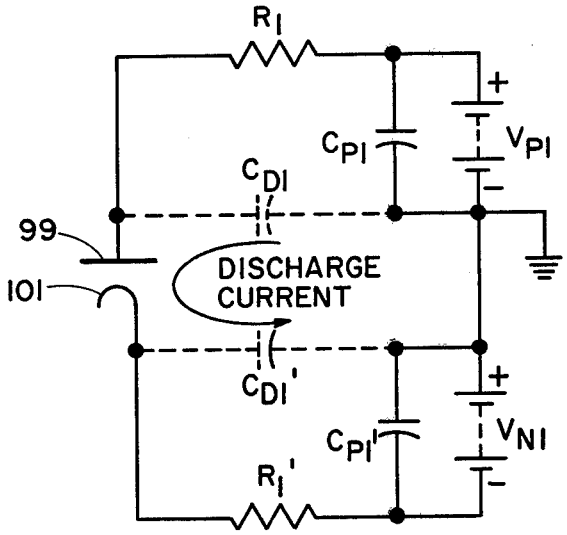
Figure 4C:
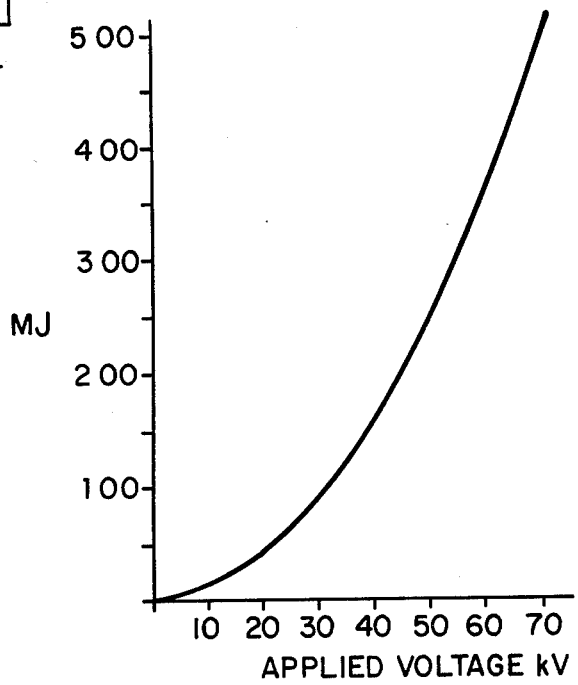
FIG. 4C shows graphically the relationship between energy stored by a 200 picofarad capacitor and potentials in kilovolts.

The stored energy of the residual capacitance is, of course, quadratically dependent upon capacitor voltage; this dependency is illustrated by FIG. 4C. If a bipolar power supply arrangement is employed according to an embodiment of the invention, the stored energy may be reduced below the destructive level. A bipolar power source is illustrated schematically in FIG. 4B, wherein spot-knocking is to be induced between an anode electrode 99 and adjacent electrode 101. Power supply capacitances $C_{P1}$ and $C_{P1'}$ associated with high voltage sources $V_{P1}$ and $V_{P1'}$ are shown as being largely isolated from the tube by isolating resistors $R_1$ and $R_{1'}$, respectively. As a result, the residual capacitance $C_{D1}$ and $C_{D1'}$ will generally be equal to or lower in value than the analogous capacitance $C_D$ of the unipolar power supply shown by FIG. 4A.

For exemplary purposes, $V_{P1}$ is considered as providing a positive potential of 35 kilovolts to anode electrode 99, while $V_{N1}$ provides a potential of −35 kilovolts to electrode 101. The potential across the tube electrodes is the same value; that is 70 kilovolts, shown as being applied by the unipolar power supply circuit, FIG. 4A. However, the stored energy $E_1$, is now the sum of the energy stored in the two capacitors $C_{D1}$ and $C_{D1}'$; that is, $$E_1 = \tfrac{1}{2}\times 200\times 10^{-12}\times(35\times 10^3)^2 + \tfrac{1}{2}\times 200\times 10^{-12}\times(35\times 10^3)^2 = 245\text{ mJ} \tag{3}$$

The value of 245 millijoules is considered to be below the destructive threshold.

It is not necessary that power supplies $V_{P1}$ and $V_{N1}$ have an equal output voltages; that is, thirty-five kilovolts and minus thirty-five kilovolts respectively. If the two capacitances $C_{D1}$ and $C_{D1'}$ are equal, however, this provides a minimum stored energy condition. The respective power sources according to the claimed invention preferably provide a positive potential of fifty kilovolts to the anode electrode, and minus twenty-five kilovolts to the adjacent electrode (or electrodes), with the potentials having values which are at least long-term averages.

Other benefits accrue through the use of a bipolar power supply according to the invention, in addition to the salient one of reducing the energy of the spot-knocking arc to a non-destructive level. For example, the potential across the electrodes may be increased from the practical maximum of about fifty kilovolts with the unipolar power source, to a much higher seventy-five kilovolts with the bipolar means according to the invention. The higher potential provides for much greater efficiency in the spot-knocking method, reducing process time by more than half and with the added benefit of more efficient and thorough clean-up of electrode addressing faces. Further, conducting a high spot-knocking potential of seventy kilovolts produced by a unipolar power supply (if such were feasible) would be very troublesome and fraught with problems such as conductor corona or other breakdown of the insulation of the conductor. Also, the higher potential across the electrodes to be spot-knocked made possible by the bipolar power supply according to the invention makes possible the spot-knocking of electron guns having certain arc-suppression means, as will be shown.

The bipolar power source according to the invention may comprise two discrete power sources, as indicated by first high-voltage power source 82 and second high-voltage power source 84 shown by FIG. 3. The power source could as well comprise a single supply having two outputs, one positive and one negative relative to a third reference potential output, which may comprise a predetermined ground. Further, application of the invention is not limited to a bipolar power source, but could as well, in certain applications, comprise the unipolar source described heretofore. For example, it may be desired to provide spot-knocking for an electron gun wherein a standard spot-knocking potential of about 40–50 kilovolts is adequate. In this case, the unipolar source could as well be used in lieu of the bipolar source according to the invention. Applying the output of a unipolar source to the embodiment of the invention shown by FIG. 3, for example, would comprise the providing of a potential from the source to first electrode 76 through resistor 83, on/off switch 85, and feed-through conductor 87. The potential would have a value at least long-term average which is many kilovolts positive relative to a predetermined ground 81. Second resistor 86 would then be connected directly to the predetermined ground 81.

Figure 5:
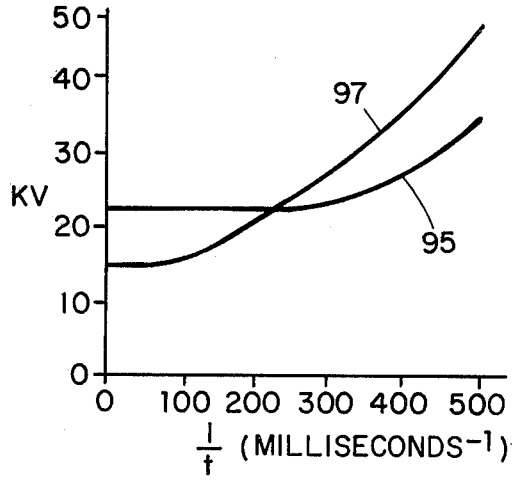
FIG. 5 shows graphically the breakdown voltage of a spark gap as a function of time.

FIG. 5 shows diagrammatically breakdown voltage as a function of time for a spark gap 90, represented by curve 95, and the breakdown voltage between two typical lead-in pins, represented by curve 97. While the breakdown potential of a spark gap and the gap between lead-in pins may be essentially the same, a spark gap characteristically discharges more rapidly for short, high voltage pulses. By the application of a spark gap according to the principles of the invention, any arcing induced by the high potential occurs in the spark gap, not between the lead-in pins. If an arc did occur between the pins, as would be highly likely without the spark gap means according to the invention, the high voltage integrity of the base-socket assembly would be destroyed.

With reference again to FIG. 2, the preferred embodiment of the invention shown diagrammatically by FIG. 3 is shown in conjunction with the cathode ray tube 24 of FIG. 2 heretofore described. As noted, tube 24 has an electron gun 34 with an extended field main focus lens 34 and arc-suppression means 66. It will be observed that the circuit portion as diagrammed in FIG. 2 is identical to the FIG. 3 circuit diagram, and with identical reference numbers.

The method according to the invention for spot-knocking the three-beam, unitized extended field lens electron gun 34 enclosed in the evacuated envelope of cathode ray picture tube 24 shown by FIG. 2 is described as follows. A first potential from first high-voltage power source 82 is applied to sixth electrode 58 through resistor 83, on/off switch 85, and feed-through conductor 44. The first potential has a value at least long-term average which is many kilovolts positive relative to a predetermined ground 81.

A second potential from second high-voltage power source 84 is applied to the interconnected third and fifth electrodes 52 and 56 through a first resistor 86 nearest pin 77A and a second resistor 88, both connected in series between pin 77A and second high-voltage power source 84. The second potential has a value at least long-term average which is many kilovolts negative relative to the aforesaid ground 81.

The lead-in pins of the lower-end electrodes 46, 48 and 50, and the lead-in pin for the fourth main focus electrode 54 are interconnected. Base-socket fixture 98 provides for such selective interconnection with the plurality of lead-in pins 32 projecting from base 30, as will be subsequently described in more detail. This interconnection of the referent lead-in pins are connected in turn to ground 81 by way of a capacitor 92, and also connected to connection point 94 between first and second resistors 86 and 88, as shown.

The second high-voltage source 84 is then activated while cyclically activating first high-voltage source 82 and adjusting the output of source 82 to provide a difference between the first and second potentials effective to induce beneficial arcing between the electrodes. The voltage across first lead-in pin 77A and the interconnected pins is discharged before a destructive arc can occur therebetween. As a result, the addressing faces of electrodes 50–52, 52–54, 54–56 and 56–58 are effectively spot-knocked according to the invention.

Figure 6:
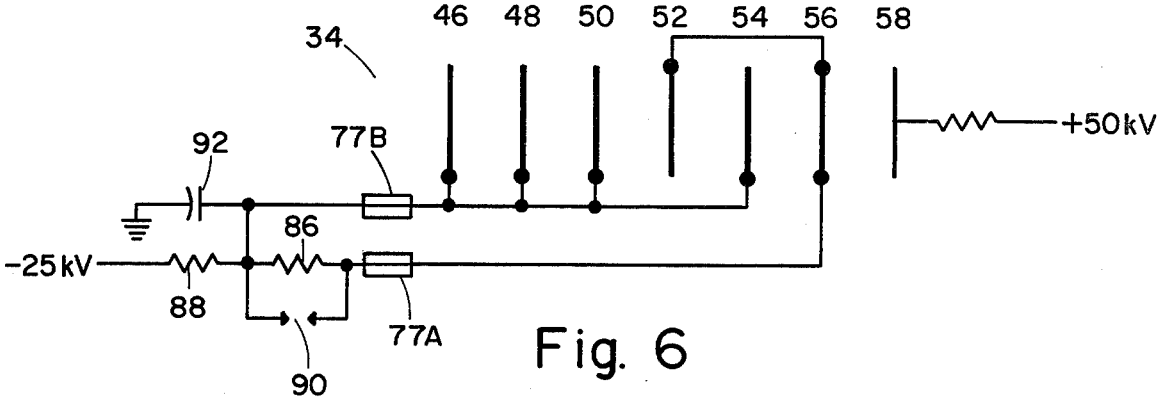
FIG. 6 shows diagrammatically the relationship of the electrodes of an extended field lens electron gun with apparatus according to the invention.

How this multi-electrode spot-knocking is accomplished by the inventive means and method is described as follows in connection with FIG. 6, which represents schematically the electron gun 34 of FIG. 2 and associated spot-knocking circuits. The lead-in pins of electrodes 46, 48, 50 and 54 should be considered as being interconnected, with the common connector represented by lead-in pin 77B. Electrodes 52 and 56 are interconnected and connected internally to the tube envelope to a lead-in pin 77A. The sequence of the spot-knocking action according to the invention comprises:

(1) The potentials noted; that is, minus twenty-five kilovolts and fifty kilovolts are applied and the difference in potential between electrodes 56 and 58 is seventy-five kilovolts; as a result, beneficial arcing is initiated between electrodes 56 and 58.

(2) As a result of arcing between electrodes 56 and 58, the voltage on electrode 56 rises at a rate predetermined by the value of resistor 88, which effectively slows the rise to maintain the beneficial arcing between the two electrodes. As the potential on electrode 56 and on interconnected electrode 52 rises and approaches fifty kilovolts, the difference in potential between electrodes 50–52, 52–54, and 54–56 in turn initiates beneficial arcing therebetween.

The voltage across the lead-in pins 77A and 77B is discharged before a destructive arc can occur therebetween by spark gap means 90 according to the invention.

It will be recognized that the invention is not limited in application to a cathode ray tube having a gun with a four-element extended field main focus lens and resistive arc-suppression means. The invention can as well be applied to many types of cathode ray picture tubes with or without such arc-suppression means, and having, for example, an electron gun with a two-electrode "bipotential" main focus lens. This type of electron gun commonly has an electrode line-up as follows, starting from the basal end: heater-and-cathode assembly, prefocusing electrodes designated as G1 and G2 respectively, and main focusing lens electrodes G3 (focusing) and G4 (anode). This type of gun is commonly spot-knocked only between electrodes G3 and G4 due to the limitations of the prior art means. The means according to the invention, however, provide for more extensive and thorough spot-knocking, as will now be described with reference to FIG. 3.

To spot-knock a bipotential electron gun according to the invention, the anode electrode G4 of the bipotential gun is connected like anode electrode 76 of FIG. 3; that is, to a first high voltage source 82 according to the invention through a resistor 83 and a switch 85. The focusing electrode G3 of the bipotential gun is connected in a manner similar to electrode 78; that is, to a second high-voltage power source 84 according to the invention through two series-connected resistors and associated spark gap means, as shown. The heater-and-cathode assembly, and the G1 and G2 electrodes are interconnected and connected to a capacitor 92 which in turn is connected to ground; the electrodes are also connected to a point midway between the two resistors, as shown and described. The first and second high-voltage sources are preferably activated as described heretofore to induce beneficial arcing between not only electrodes G3 and G4 in the bipotential gun (as in prior art means) but also between electrodes G2 and G3.

It is manifest that a cathode ray tube having an effective arc-suppression means may not be amenable to the inducement of beneficial arcing by the standard prior art spot-knocking process, as any such arcing would be quenched before any practical clean-up of the electrode faces could be accomplished. However, spot-knocking can be readily accomplished in such cathode ray tubes by the apparatus and method according to the present invention. As noted, in prior art spot-knocking systems, it is impractical to raise the spot-knocking potential much higher than forty kilovolts because of the concurrent increase in stored energy due to the inherent capacitance, with resultant high-energy arcing of a destructive nature. However, because of the higher potential provided by the spot-knocking means according to the invention without such an inordinate increase in stored energy, the arc-suppression capability of arc-suppression resistor 66 shown by FIG. 2 can be effectively nullified during the spot-knocking process without damage to resistor 66.

Arc-suppression resistor 66 according to the referent U.S. Pat. No. 4,101,803 disclosure has a surface that is widely and deeply cavitated and contorted at or below its nominal surface such that the real surface of resistor 66 is shadowed and very greatly extended in area relative to its nominal surface. By increasing the spot-knocking potential above that in prior art use, a capability provided by the means and method according to the invention, the spot-knocking current will bypass the arc-suppression resistor 66 by traveling across its surface with only minimal impedance from the aforedescribed surface. As a result, the potential on the anode electrode 56 will be substantially equal to the potential on the innerconductive coating 39, and spot-knocking between electrode 58 and adjacent electrode 56 will be accomplished. The spark gap means 90 according to the invention also plays a role in that a destructive discharge between the first lead-in pin 77A and other lead-in pins is effectively prevented.

Figure 7:
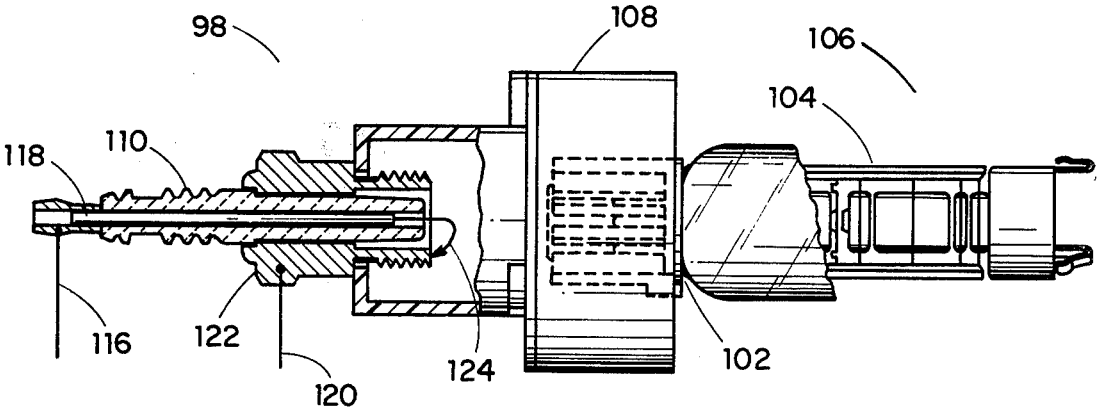
FIG. 7 is a partially phantom view in elevation of a fixture useful in implementing the invention.

Base-socket fixture 98, indicated schematically in FIG. 2, is represented in greater detail in FIG. 7. Base-socket fixture 98 is suitable for holding in necessary contiguity a cathode ray tube and a spark gap means according to the invention; such contiguity is necessary to avoid the capacitance inherent in long conductors. Base 102 of cathode ray tube 106 is shown as being plugged into socket 108 of base-socket fixture 98. Socket 108 may comprise a standard television picture tube socket adapted to accept a spark gap means 110. Socket 108 is also adapted internally to provide for the interconnection of the lead-in pins of the aforedescribed lower-end electrodes, including lead-in pin 77B (the interconnection indicated schematically by band 100 in FIG. 2). Socket 108 also provides for connection to first lead-in pin 77A.

Spark-gap means 110 may comprise, for example, a standard automotive spark plug adapted to fit socket 108. Electrical conductor 116 makes electrical contact with center electrode 118 of the spark plug. Conductor 120, shown as being electrically attached to the ground electrode 122 of the spark plug, is electrically connected to connection point 94 (see FIGS. 2 and 3). The spark plug is adapted to provide a longer-than-standard discharge path by shortening the center electrode 118, as shown. The actual gap is determined empirically as the dielectric and other properties of the fixture and associated conductors will vary. The actual gap is a compromise in that the gap must discharge the potential between the lead-in pins before an arc accurs therebetween; conversely, the discharge must not occur before the desired spot-knocking takes place. A gap of about three-eighths of an inch has been found to be efficaceous. The resulting discharge is indicated symbolically by spark path 124; the breakdown voltage may be, for example, about twenty kilovolts.

The output of the first high-voltage source is preferably adjustable with means provided for cycling the voltage on and off. A progressive increase in voltage is desired for effective clean-up of the electrode faces. Beneficial arcing at a difference in potential of forty kilovolts, for example, has been found to remove the most predominant of the particles to be cleaned from the faces. As the voltage is increased, particles of lesser predominance are progressively removed as the voltage is progressively increased.

Cycling the spot-knocking voltage on and off is also desirable. If the arcing is sustained for too long a period; e.g., for much longer than one second, the energy dissipated in the arcing can build up to a point where the arcing is no longer beneficial but potentially destructive.

An effective spot-knocking program according to the invention may comprise the following, with reference to FIG. 3. Second high-voltage source 84 is preferably maintained at a potential of minus twenty-five kilovolts, for example. The potential of first high-voltage source 82 may be progressively increased in five kilovolt increments from twenty-five kilovolts to fifty kilovolts in, for example, five steps. The output of first high-voltage source 82 is preferably turned on and off at a rate typically of one-quarter second on and three-quarter second off; this on-off cycling is continued for thirty-six seconds for each of the first four steps. During the final step wherein the potential is at the fifty kilovolts level, (providing a total difference is potential of 75 kilovolts) the per-second divisions may be one-eighth of a second on, and seven-eighths of a second off. The total time required to spot-knock a cathode ray picture tube according to the program described is a little more than four minutes, or considerably less than half the time required to spot-knock an electron gun by typical prior art means.

It is to be noted that the program described and the values expressed are in no way limiting but are provided as descriptive of a program that has proved its value in practice.

Figure 8:
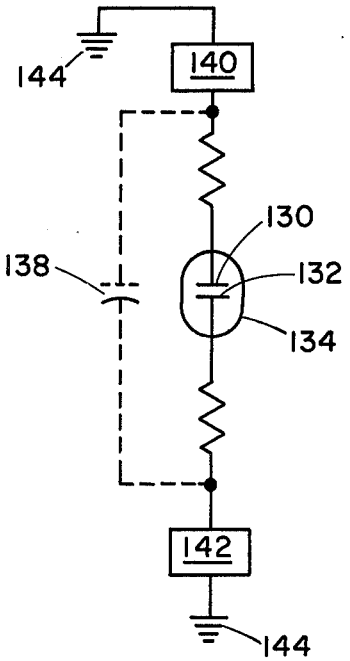
FIG. 8 is a schematic diagram of yet another embodiment of the invention.

Other changes may be made in the above-described apparatus without departing from the true spirit and scope of the invention herein involved. For example, it may be desired to induce spot-knocking between only two electrodes; that is, for example, electrodes 130 and 132 of the cathode ray picture tube indicated symbolically in FIG. 8. Since there are only two electrodes to be spot-knocked, the spark gap means according to the invention is not required in this embodiment of the invention. Each electrode 130 and 132 is connected to a separate electrical connector extending through the envelope 134. The picture tube has an inherent capacitance that can store energy in an amount capable of supporting a destructive arc during spot-knocking; this capacitance is indicated by the dash-line capacitor 138, and associated conductors. The method comprises applying a first potential according to the invention to electrode 130, the potential having a value at least long-term average which is many kilovolts positive relative to a predetermined ground 144 indicated symbolically. The potential is shown as being applied by a source 140 which may comprise a full-wave power supply that is adjustable and which can be cycled on and off according to a predetermined program.

A second potential according to the invention is applied to electrode 132; this potential has a value at least long-term average which is many kilovolts negative relative to the ground. The second potential is indicated as being supplied by a source 142 which may, for example, comprise a half-wave power supply. The difference between the first and second potentials is such as to induce beneficial arcing between the electrodes. The application of the bipolar potential across electrodes 130 and 132 provides an amount of energy in the induced arcing, for a given applied potential, very much less than would be the case if a unipolar potential were applied.

The first and second potentials may be selected to provide a difference in potential across electrodes 130 and 132 in the range of forty to eighty kilovolts, and the stored energy is limited according to the invention to a range of ten to three hundred millijoules. The first potential is preferably in the range of thirty to fifty kilovolts, and the second potential is preferably in the range of minus ten to minus thirty kilovolts.

It is intended that the subject matter in the foregoing depiction of the invention shall be interpreted as illustrative and not in a limiting sense.

We claim:

1. An apparatus for spot-knocking an electron gun enclosed in the evacuated envelope of a cathode ray picture tube by inducing beneficial arcing between two selected electrodes of said gun, each electrode being connected to an associated electrical conductor extending through said envelope, said picture tube having an inherent capacitance that can store energy in an amount capable of supporting a destructive arc during said spot-knocking said apparatus comprising:

a first high-voltage source connected to one of said electrodes through its associated electrical conductor for supplying a first potential to said electrode, said potential having a value at least long-term average which is many kilovolts positive relative to a predetermined ground;

a second high-voltage source connected to the other of said electrodes through its associated electrical conductor for supplying a second potential to said other electrode, said potential having a value at least long term average which is many kilovolts negative relative to said ground, the difference between said first potential and said second potential being effective to induce said beneficial arcing between said electrodes;

whereby, by the application of the bipolar potential across said electrodes, the amount of energy in the induced arcing, for a given applied potential, is very much less than would be the case if a unipolar potential were applied.

2. The spot-knocking apparatus defined by claim 1 wherein said first and second potentials are selected to provide a difference in potential across said electrodes in the range of forty to eighty kilovolts.

3. The spot-knocking apparatus defined by claim 1 wherein stored energy is limited to a range of ten to three hundred millijoules.

4. The spot-knocking apparatus defined by claim 1 wherein said first potential is in the range of thirty to fifty kilovolts, and said second potential is in the range of minus fifteen to minus thirty kilovolts.

5. A spot-knocking apparatus for an electron gun enclosed in the evacuated envelope of a cathode ray picture tube, said apparatus inducing beneficial arcing between selected electrodes of said gun, said envelope including a base, a neck, a funnel having a feed-through conductor for conducting a high voltage to a conductive coating deposited on an inner surface thereof, and a faceplate with a luminescing screen, said electron gun projecting at least one electron beam on said screen, said gun having a first electrode proximate to said faceplate and connected to said conductive coating, a third electrode proximate to said base connected to a second lead-in pin through said base, and a second electrode between said first and third electrodes connected to a first lead-in pin, said picture tube having an inherent capacitance that can store energy in an amount capable of supporting a destructive arc during said spot-knocking, said spot-knocking apparatus comprising:

a first high-voltage source connected to said feed-through conductor for supplying a first potential to said first electrode, said first source providing a first potential having a value at least long-term average which is many kilovolts positive relative to a predetermined ground:

a second high-voltage source connected to said first lead-in pin for supplying a second potential to said second electrode through a series-connected first resistor nearest said lead-in pin and a second resistor, said second potential having a value at least long-term average which is many kilovolts negative relative to said ground, the difference between said first and second potentials being such as to induce beneficial arcing between said electroes;

capacitive means connected between said ground and said second lead-in pin leading to said third electrode, and to a point between said first and second resistors; and, spark-gap means in parallel connection with said first resistor;

whereby, by the application of the bipolar potential across said electrodes, the amount of energy in the induced arcing, for a given applied potential, is very much less than would be the case if a unipolar potential were applied; and whereby said spark gap means provides for discharging the voltage between said lead-in pins before a destructive arc can occur therebetween.

6. A spot-knocking apparatus for an electron gun enclosed in the evacuated envelope of a cathode ray tube, said apparatus inducing beneficial spot-knocking arcing between selected electrodes of said gun, said evacuated envelope including a base, a neck, a funnel having a feed-through conductor for conducting a high-voltage to a conductive coating deposited on an inner surface thereof, and a faceplate with a luminescing screen, said electron gun projecting at least one electron beam on said screen, said gun having a first electrode proximate to said faceplate and connected to said conductive coating, a third electrode proximate to said base connected to a second lead-in pin through said base, and a second electrode between said first and third electrodes connected to a first lead-in pin, said picture tube having an inherent capacitance that can store energy in an amount capable of supporting a destructive arc during said spot-knocking, said spot-knocking apparatus comprising:

a high-voltage source connected to said feed-through conductor for providing a potential to said first electrode, said potential having a value at least long-term average that is many kilovolts positive relative to a predetermined ground;

a first resistor and a second resistor series-connected between said first lead-in pin leading to said second electrode and said ground, said first resistor being nearest said first lead-in pin;

capacitive means connected between said ground and said second lead-in pin leading to said third electrode, and to a point between said first and second resistors;

spark gap means in parallel connection with said first resistor;

whereby, the difference in potential between said electrodes is such as to induce beneficial arcing between said electrodes, and whereby said spark gap means provides for discharging the voltage between said lead-in pins before a destructive arc can occur therebetween.

7. A method for spot-knocking an electron gun enclosed in the evacuated envelope of a cathode ray picture tube by inducing benefical arcing between two selected electrodes of said gun, each electrode being connected to an associated electrical conductor extending through said envelope, said picture tube having an inherent capacitance that can store energy in an amount capable of supporting a destructive arc during said spot-knocking, the said spot-knocking method comprising:

connecting a first high-voltage source to one of said electrodes through its associated electrical conductor, and supplying a first potential to said electrode having a value at least long-term average which is many kilovolts positive relative to a predetermined ground;

connecting a second high-voltage source to the other of said electrode through its associated electrical conductor and supplying a second potential to said other electrode having a value at least long-term average which is many kilovolts negative relative to said ground, the difference between said first potential and said second potential being such as to induce said beneficial arcing between said electrodes.

whereby, by the application of the bipolar potential across said electrodes, the amount of energy in the induced arcing, for a given applied potential, is very much less than would be the case if a unipolar potential were applied.

8. The spot-knocking method defined by claim 7 wherein said first and second potentials are selected to provide a difference in potential across said electrodes in the range of forty to eighty kilovolts.

9. The spot-knocking method defined by claim 7 wherein stored energy is limited to a range of ten to three hundred millijoules.

10. The spot-knocking method defined by claim 7 wherein said first potential is in the range of thirty to fifty kilovolts, and said second potential is in the range of minus fifteen to minus thirty kilovolts.

11. A method for spot-knocking an electron gun enclosed in the evacuated envelope of a cathode ray picture tube by inducing beneficial arcing between selected electrodes of said gun, said evacuated envelope including a base, a neck, a funnel having a feed-through conductor for conducting a high-voltage to a conductive coating deposited on an inner surface thereof, and a faceplate with a luminescing screen, said gun having a first electrode proximate to said faceplate and connected to said conductive coating, a third electrode proximate to said base connected to a second lead-in pin through said base, and a second electrode between said first and third electrode connected to a first lead-in pin, and wherein said picture tube has an inherent capacitance that can store energy in an amount capable of supporting a destructive arc during said spot-knocking, the method comprising:

applying a first potential to said first electrode through said feed-through conductor, said potential having a value at least long-term average which is many kilovolts positive relative to a reference potential;

applying a second potential to said second electrode through said first lead-in pin through a series-connected first resistor nearest said lead-in pin and a second resistor connected to the source of said second potential, said potential having a value at least long-term average which is many kilovolts negative relative to said first potential, the difference between said first and second potentials being such as to induce said beneficial arcing between said electrodes;

connecting said second lead-in pin to a point between said first and second resistors, and to a ground through capacitive means;

discharging the voltage across said first and second lead-in pins before a destructive arc can occur therebetween.

12. A method for spot-knocking an electron gun enclosed in the evacuated envelope of a cathode ray picture tube by inducing benefical arcing between selected electrodes of said gun, said evacuated envelope including a base, a neck, a funnel having a feed-through conductor for conducting a high-voltage to a conductive coating deposited on an inner surface thereof, and a faceplate with a luminescing screen, said gun having a first electrode proximate to said faceplate and connected to said conductive coating, a third electrode proximate to said base connected to a second lead-in pin through said base, and a second electrode between said first and third electrode connected to a first lead-in pin, and wherein said picture tube has an inherent capacitance that can store energy in an amount capable of supporting a destructive arc during said spot-knocking, the method comprising:

applying a first potential to said first electrode through said feed-through conductor, said potential having a value at least long-term average which is many kilovolts positive relative to a predetermined ground;

applying a second potential to said second electrode by way of said first lead-in pin through a series-connected first resistor nearest said lead-in pin and a second resistor connected to the source of said second potential, said potential having a value at least long-term average which is many kilovolts negative relative to said ground, the difference between said first and second potentials being such as to induce said beneficial arcing between said electrodes;

connecting said second pin to a point between said first and second resistors, and to said ground through capacitive means;

discharging the voltage across said first and second lead-in pins before a destructive arc can occur therebetween;

whereby, by the application of the bipolar potential across said electrodes, the amount of energy in the induced arcing, for a given applied potential, is very much less than would be the case if a bipolar potential were applied; and destructive arcing between said pins is prevented.

13. A method for spot-knocking a three-beam, unitized, extended field lens electron gun enclosed in the evacuated envelope of a cathode ray picture tube having a resistive arc-suppression zone and static elimination system, said envelope including a base, a neck, a funnel having a feed-through conductor for conducting a high voltage to an inner conductive coating deposited on said funnel, and a faceplate with a luminescing screen, said gun being located in said neck and having discrete electrodes connected to lead-in pins extending through said base, said gun having lower-end electrodes proximate said base including heater and cathode electrodes, and first and second prefocus electrodes; and upper-end main focus lens third, fourth, fifth and sixth electrodes proximate said faceplate, with said third and fifth electrodes electrically inter-connected internal to said envelope and connected to a first lead-in pin, with said sixth electrode connected to said inner conductive coating through said resistive arc-suppression means, and wherein said picture tube has an inherent capacitance that can store energy in an amount capable of supporting a destructive arc during said spot-knocking, the method comprising:

applying a first potential to said sixth electrode through a resistor, an on/off switch, and said feed-through conductor, said potential having a value at least long-term average which is many kilovolts positive relative to a predetermined ground;

applying a second potential to said interconnected third and fifth electrodes by way of said first lead-in pin and through a first resistor nearest said pin and a second resistor connected in series between said second lead-in pin and the source of said potential, said second potential having a value at least long-term average which is many kilovolts negative relative to said ground;

interconnecting the lead-in pins of said lower-end electrodes and said fourth main focus lens electrode, and connecting said interconnected pins to said ground by way of a capacitor, and to a point between said first resistor and said second resistor;

applying said second potential while cyclically applying said first potential and adjusting said first potential to provide a difference between said potentials effective to induce beneficial arcing between said electrodes;

discharging the voltage across said first lead-in pin and said inter-connected pins before a destructive arc can occur therebetween;

whereby, by the application of the bipolar potential across said electrodes, the amount of energy in the induced arcing, for a given applied potential, is very much less than would be the case if a unipolar potential were applied and whereby destructive arcing between said lead-in pins is prevented, and the total potential across the electrodes to be spot-knocked is at a level high enough to overcome the resistance of said arc-suppression means.

* * * * *